US007992979B2

(12) United States Patent
Horie

(10) Patent No.: US 7,992,979 B2
(45) Date of Patent: Aug. 9, 2011

(54) INK-JET RECORDING APPARATUS

(75) Inventor: Kaoru Horie, Hachioji (JP)

(73) Assignees: Olympus Corporation, Tokyo (JP); Ortek Corporation, Tokyo (JP)

( * ) Notice: Subject to any disclaimer, the term of this patent is extended or adjusted under 35 U.S.C. 154(b) by 532 days.

(21) Appl. No.: 12/148,251

(22) Filed: Apr. 17, 2008

(65) Prior Publication Data

US 2008/0259140 A1 Oct. 23, 2008

(30) Foreign Application Priority Data

Apr. 19, 2007 (JP) ..... 2007-110754

(51) Int. Cl.
*B41J 2/175* (2006.01)

(52) U.S. Cl. ..... 347/85; 347/27; 347/92; 347/86

(58) Field of Classification Search ..... 347/27, 347/85–86, 92, 94
See application file for complete search history.

(56) References Cited

U.S. PATENT DOCUMENTS 6,695,441 B2 * 2/2004 Asano ..... 347/86

FOREIGN PATENT DOCUMENTS

JP 11-48492 A 2/1999

* cited by examiner

*Primary Examiner* — Ellen Kim

(74) *Attorney, Agent, or Firm* — Holtz, Holtz, Goodman & Chick PC

(57) ABSTRACT

An ink-jet recording apparatus is provided with an ink tank, a recording head, an ink passage extending from the ink tank to the recording head, and a sub-tank arranged on the ink passage. The apparatus has a first ink passage, a second ink passage, and an ultrasonic transducer. The first ink passage supplies ink from the ink tank to the sub-tank. The second ink passage has an ink outlet port, through which the ink is drawn from the sub-tank into the recording head. The ultrasonic transducer applies ultrasonic vibration to the ink contained in the sub-tank. The ink outlet port of the second ink passage is arranged near the ultrasonic transducer.

20 Claims, 10 Drawing Sheets

INK-JET RECORDING APPARATUS

CROSS-REFERENCE TO RELATED APPLICATIONS

This application is based upon and claims the benefit of priority from prior Japanese Patent Application No. 2007-110754, filed Apr. 19, 2007, the entire contents of which are incorporated herein by reference.

BACKGROUND OF THE INVENTION

1. Field of the Invention

The present invention relates to an ink-jet recording apparatus. More particularly, the invention relates to an improved ink-jet recording apparatus that can keep supplying bubble-free ink to the recording head.

2. Description of the Related Art

Ink-jet recording apparatuses have a print head having nozzles, through which ink is ejected when a signal is input from a computer, thereby recording characters and/or images on a recording medium. Any ink-jet recording apparatus is composed, mainly of a recording head unit, an ink tank, and an ink-supplying tube. The recording head unit ejects ink, recording images. The ink tank contains ink to be supplied to the recording head unit. The ink-supplying tube connects the ink tank to the recording head unit.

Ink-jet recording apparatuses thus configured are classified into two types. In one type, the ink tank is replaced by a new one when it becomes empty, whereas the recording head is not replaced at all. In the other type, the recording head and the ink tank are integrally formed, and not only the ink tank but also the recording head is replaced with a new one when the ink tank becomes empty.

In the first-mentioned type, the joint unit, to which the ink tank is attached, is exposed to air when the ink tank is detached from it. Consequently, bubbles enter the ink passage that extends from the ink tank to the recording head. If the bubbles move into the nozzles of the recording head, the ink will be, most probably, not ejected well.

An ink jet recording apparatus designed to solve this problem is disclosed in Jpn. Pat. Appln. KOKAI Publication No. 11-48492. This apparatus has a deaeration unit for deaerating the ink passage that extends from the ink tank to the recording head.

The ink-jet recording apparatus disclosed in Jpn. Pat. Appln. KOKAI Publication No. 11-48492 is composed, mainly of a main tank, a deaerator, a relay tank, a recording head, and a tube. The main tank can be replenished with ink. The tube connects the deaerator, relay tank and recording head to the main tank through valves. The deaerator comprises a tank, an ultrasonic transducer, and a vacuum pump. The tank has an ink inlet port through which ink may flow from the main tank and an ink-outlet port through which ink may flow into the relay tank. The ultrasonic transducer is provided on the bottom of the tank. The vacuum pump communicates with the upper part of the tank.

In the ink-jet recording apparatus thus configured, ink flows into the tank through the ink inlet port. Vibrated at high frequency by the ultrasonic transducer, the ink undergoes cavitation. At this point, the vacuum pump is driven. The bubbles are thereby removed from the ink and expelled from the tank. Thus, the ink is deaerated. The ink deaerated is supplied through the ink outlet port or through the relay tank to the recording head. The recording head can therefore print data.

BRIEF SUMMARY OF THE INVENTION

An object of the present invention is to provide an ink-jet recording apparatus in which the ultrasonic transducer secured to the tank has a specific positional relation with the ink outlet port of the tank and bubble-free ink is therefore continuously supplied to the recording head at high efficiency.

To achieve the object, an ink-jet recording apparatus according to this invention has an ink tank containing ink, a recording head, an ink passage extending from the ink tank to the and the recording head, and a sub-tank provided on the ink passage, and configured to record images on a recording medium. The ink-jet recording apparatus comprises: a first ink passage having an ink inflow port through which the ink is supplied from the ink tank to the sub-tank; a second ink passage having an ink outlet port through which the ink is drawn from the sub-tank and supplied to the recording head; and an ultrasonic transducer configured to generate an ultrasonic wave, thereby forming a standing-wave field in the ink contained in the sub-tank, the standing-wave field having a sound-pressure antinode. The ink outlet port of the second ink passage is arranged near the ultrasonic transducer.

Advantages of the invention will be set forth in the description which follows, and in part will be obvious from the description, or may be learned by practice of the invention. Advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the present invention will be described in detail, with reference to the accompanying drawings.

First Embodiment

Figure 1:
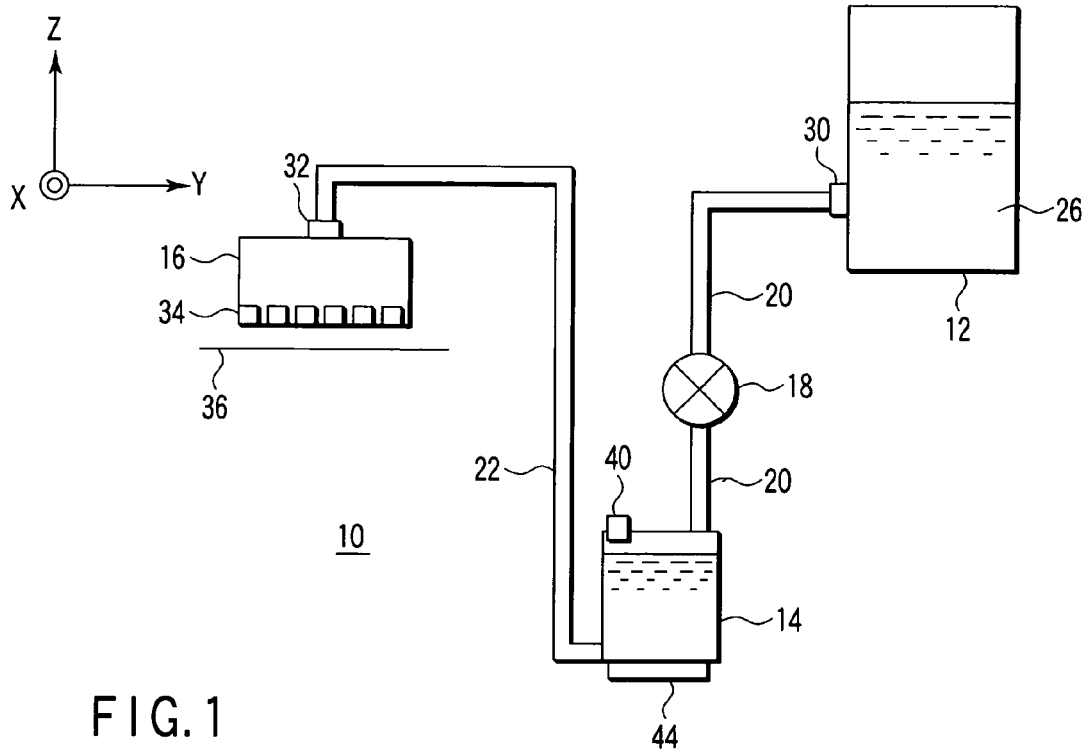
FIG. 1 is a diagram showing an ink-jet recording apparatus according to a first embodiment of this invention, illustrating the ink passage provided in the ink-jet recording apparatus.

FIG. 1 shows an ink-jet recording apparatus 10 according to a first embodiment of the invention, schematically illustrating the ink passage in the apparatus.

FIG. 1 shows only one ink passage. Nonetheless, the apparatus may have a plurality of similar ink passages if it uses inks of different colors to record data. In the following description of this apparatus, the direction in which a recording medium is fed will be referred to as X-axis direction; the direction in which the recording nozzles of the recording head are arranged (i.e., direction intersecting with the direction of feeding the recording medium) as Y-axis direction; and the direction of gravity (i.e., direction intersecting with the XY plane) as Z-axis direction.

As shown in FIG. 1, the ink-jet recording apparatus 10 has an ink bottle 12, a sub-tank 14, and a recording head 16. The ink bottle 12 and the sub-tank 14 are connected by a first ink passage 20, on which a valve 18 is provided. Ink 26 can therefore be supplied from the ink bottle 12 to the sub-tank 14 through the first ink passage 20. The first ink passage 20 is connected, at one end, to the ink bottle 12 by a joint 30. Thus, the first ink passage 20 can be detached, at this end, from the ink bottle 12. At the other end, the ink passage 20 is connected to the top of the sub-tank 14, as will be described later in detail. The valve 18 is provided to control the flow rate of the ink 26 being supplied from the ink bottle 12 to the sub-tank 14.

A second ink passage 22 connects the sub-tank 14 to the recording head 16. The ink 26 can therefore be supplied from the sub-tank 14 to the recording head 16 through the second ink passage 22. The second ink passage 22 is connected at one end to the bottom of the sub-tank 14, as will be described later in detail. At the other end, the second ink passage 22 is connected by a joint 32 to the recording head 16. Said one end of the second ink passage 22 can be disconnected from the recording head 16.

The recording head 16 has a plurality of nozzles 34, through which the ink 26 may be ejected. Through the nozzles 34, the ink 26 supplied from the sub-tank 14 may be ejected from the recording head 16 to a recording medium 36 that opposes the recording head 16. Accordingly, an image is recorded on the medium 36. The recording head 16 may be a serial type that moves over the recording medium 36, thereby recording an image on the medium 36. Alternatively, the head 16 may be a line type that is fixed in position, extending in Y-axis direction for a distance longer than the width of the recording medium 36, and records an image on the medium 36 as the medium 36 is moved once in X-axis direction.

The ink-jet recording apparatus 10 comprises a sheet-feeding unit, a medium-transporting mechanism, and a medium-ejecting unit, which are not shown. The sheet-feeding unit feeds the recording medium 36. The transporting unit transports the recording medium 36 forward from the sheet-feeding unit. The medium-ejecting unit ejects recording media 36 from the ink-jet recording apparatus 10.

Figure 2:
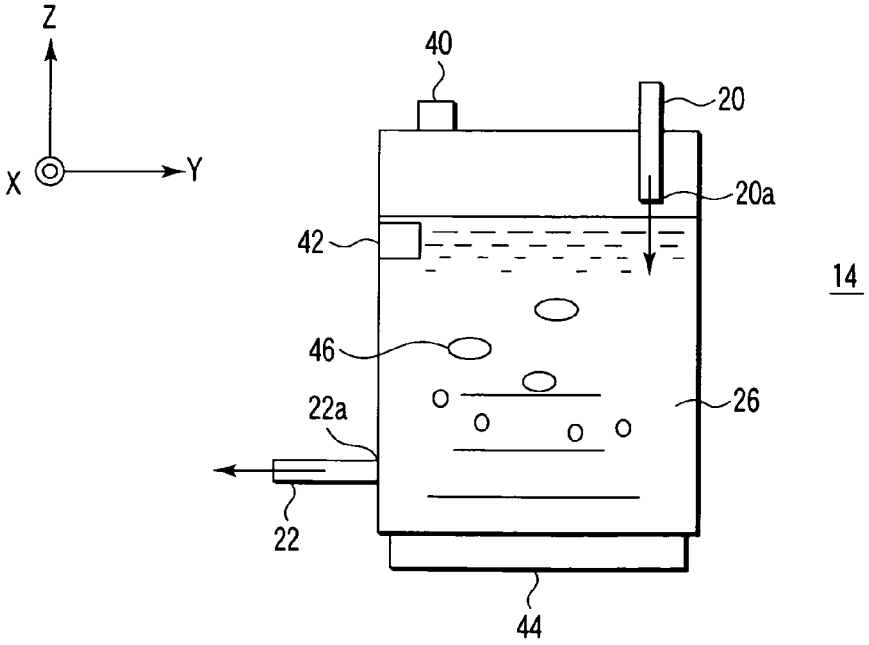
FIG. 2 is a magnified view of the sub-tank 14 shown in FIG. 1.

FIG. 2 is a magnified view of the sub-tank 14 shown in FIG. 1.

As shown in FIG. 2, an ink inlet port 20*a* connected to the other end of the first ink passage 20 is connected to the sub-tank 14 without being immersed in the ink 26 contained in the sub-tank 14. The ink inlet port 20*a* is provided to supply the ink 26 to the sub-tank 14 from the ink tank 12. An ink outlet port 22*a* connected to one end of the second ink passage 22 communicates with the interior of the sub-tank 14 containing the ink 26. Through the ink outlet port 22*a*, the ink 26 flows to the recording head 16 from the sub-tank 14.

The sub-tank 14 has an atmosphere port 40, a liquid-level sensor 42, and an ultrasonic transducer 44. The atmosphere port 40 connects the interior of the sub-tank 14 to the atmosphere. The liquid-level sensor 42 detects the surface level of the ink 26 contained in the sub-tank 14. The ultrasonic transducer 44 is provided so that ink with no bubbles can flow into the ink outlet port 22*a* of the second ink passage 22. Thus, bubble-free ink 26 is supplied to the recording head 16.

It is desired that the ultrasonic transducer 44, on which the sub-tank 14 is mounted or which emits sound waves, should have a circular surface. This is because, if the transducer 44 has a rectangular surface or any other polygonal surface, stress will concentrate at each corner when the transducer 44 is driven, possibly cracking the ultrasonic transducer 44.

The surface level of the ink 26 in the sub-tank 14 is monitored by the liquid-level sensor 42 and is controlled so that a prescribed negative pressure (water head) may be applied to the nozzles 34. In other words, the surface level of the ink 26 in the sub-tank 14 is set lower than the nozzles 34, in the direction of gravity. Hence, the ink would not drip from the nozzles 34. The surface level of the ink 26 in the sub-tank 14 is not limited to what was described above. Rather, it may be higher than the nozzles 34, with respect to the direction of gravity, so long as the prescribed negative pressure is applied to the nozzles 34.

The ink 26 flowing into the sub-tank 14 through the ink inlet port 20*a* of the first ink passage 20 contains bubbles 46. The bubbles 46 develop as air is drawn into the first ink passage 20 at joint 30 when the ink tank 12 is attached to or detached from the first ink passage 20 by using the ink joint 30. The bubbles 46 develop also at the valve 18 provided on the first ink passage 20 when the valve 18 is opened or closed.

In the sub-tank 14, the bubbles 46 usually move to the ink outlet port 22*a* of the second ink passage 22, because of the force with which the recording head 16 draws (or ejects) the ink. If the bubbles 46 moves into the recording head 16, they ultimately move into the nozzles 34. Consequently, the ink may not be ejected as is desired. To prevent this, the ink outlet port 22*a* and the ultrasonic transducer 44 are so arranged, generating a standing-wave field. The standing-wave field guides the bubbles 46 in the ink 26, which has been supplied into the sub-tank 14 via the ink inlet port 20*a*, upwards in Z-axis direction before the bubbles 46 reach the ink outlet port 22*a*. The ink 26 free of bubbles is therefore supplied from the sub-tank 14 through the ink outlet port 22*a*.

Figure 3:
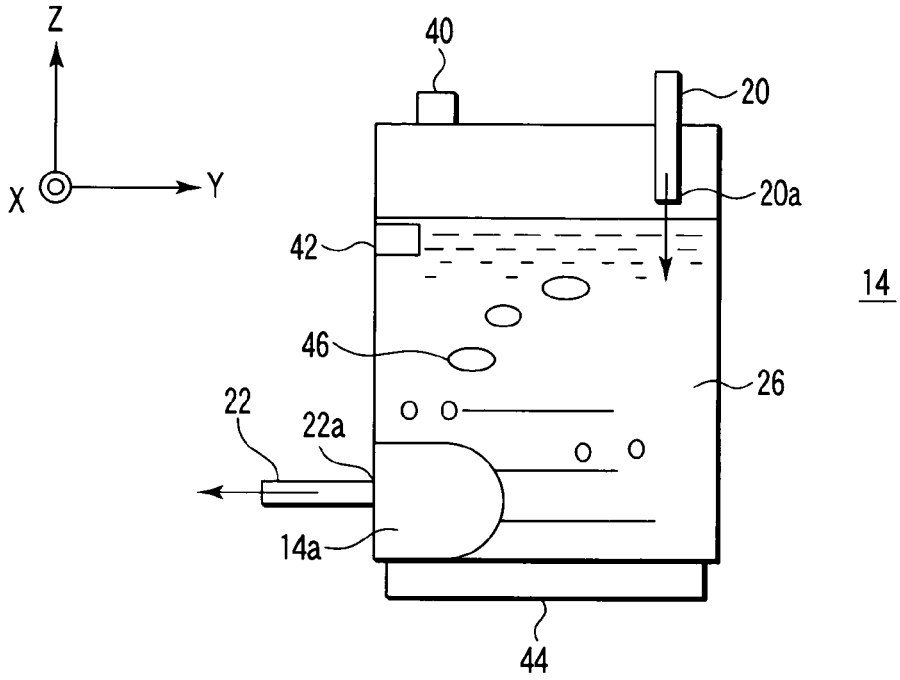
FIG. 3 is a diagram of that part 14*a* of the sub-tank 14, which lies near the ink outlet port 22*a;*

That is, it suffices to remove bubbles 46 from that part 14*a* of the sub-tank 14, which lies near the ink outlet port 22*a*, as is illustrated in FIG. 3. No problems will arise if the bubbles 46 remain at any other part of the sub-tank 14. In other words, it is sufficient to arrange the ink outlet port 22*a* and the ultrasonic transducer 44 such that the bubbles 46 rise faster than the ink 26 flows in the part 14*a* of the sub-tank 14.

Namely, V1>V2 where V1 is the speed of bubbles 46 rising in the part 14*a* of the sub-tank 14, and V2 is the speed of ink 26 flowing into the ink outlet port 22*a*.

If no ultrasonic waves are applied to the ink 26, the higher the bubbles rise in Z-axis direction, the more slowly they move. This is because the pressure exerted on the bubbles is proportional to the depth measured from the surface level of the ink. Thus, each bubble gradually becomes larger and broader as it rises up in the ink. The broader it becomes the greater resistance it will receive. Thus, the higher it rises, the more slowly it will move.

Figure 4:
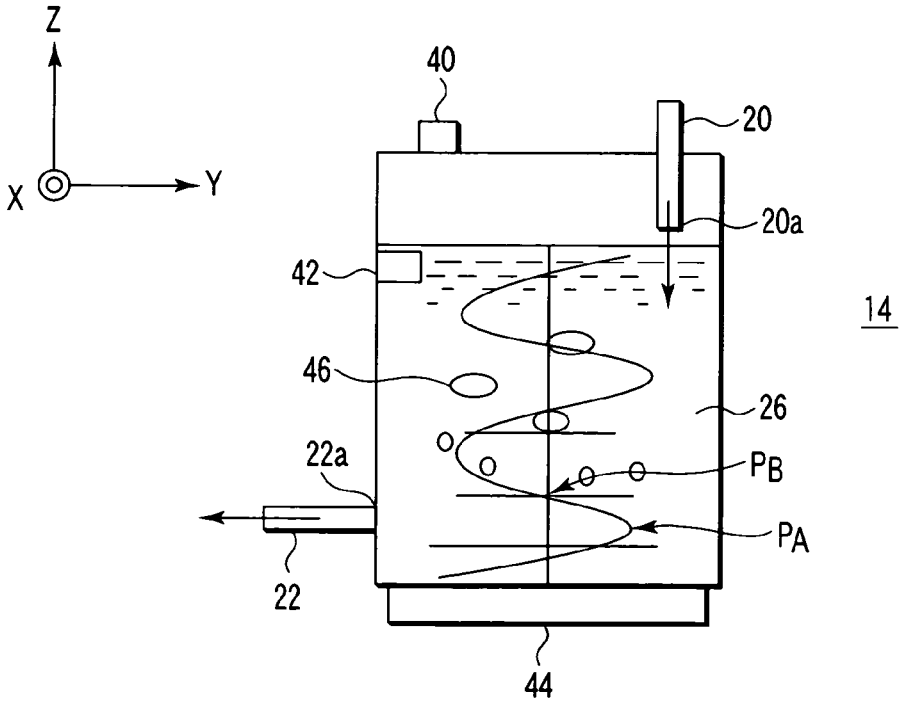
FIG. 4 is a diagram showing a pressure-wave relation that is observed when an ultrasonic wave is applied to the sub-tank 14.

FIG. 4 is a diagram showing a pressure-wave relation that is observed when an ultrasonic wave is applied to the sub-tank 14.

As FIG. 4 shows, one cycle (wavelength) of the ultrasonic wave propagating in the ink is determined by the velocity of sound propagating in liquid and the frequency of the sound, as is given below:

$$\text{Wavelength}=\text{Sound velocity}\div\text{sound frequency} \quad (1)$$

When the ultrasonic transducer 44 continuously emits ultrasonic waves into the ink, a standing wave is generated in the ink. As shown in FIG. 4, the standing wave consists of antinodes $P_A$ (hills) and nodes $P_B$ (valleys), all fixed in position. Antinodes $P_A$ and nodes $P_B$ are alternately generated at intervals of a quarter of wavelength (¼ wavelength). If an ultrasonic wave is applied to the sub-tank 14 in which bubbles 46 exist, the bubbles 46 come together, forming an air layer, first in the vicinity of the ultrasonic transducer 44. The bubbles 46 gradually move upwards in Z-axis direction. At this point, the bubbles 46 rise slowly at the nodes of sound pressure and fast at the antinodes of sound pressure. In other words, the antinodes of sound pressure, where the bubbles 46 rise fast, are formed at intervals of half the wave length (i.e., ½ wavelength). In view of this, the ink outlet port 22*a* of the second ink passage 22 should be arranged near one of the antinodes of sound pressure.

As has been pointed out, the deeper the bubbles 46 lie in the ink, the faster they will rise. Hence, in the present embodiment, the ink outlet port 22*a* of the second ink passage 22 is arranged near the ultrasonic transducer 44 as shown in FIG. 4 so that the bubbles 46 may not move from the sub-tank 14 into the ink outlet port 22*a* of the second ink passage 22. More specifically, it is desirable to arrange the ink outlet port 22*a* near the antinode of sound pressure, which has been formed first in the propagation direction of the ultrasonic wave emitted from the ultrasonic transducer 44.

In the present embodiment, the ultrasonic transducer 44 is of the type usually used in ultrasonic-wave washers, which generates ultrasonic waves at a frequency ranging from 20 kHz to 100 kHz. To cause the ultrasonic transducer 44 to generate a standing wave at high efficiency, the sub-tank 14 is so arranged that its bottom, to which the transducer 44 is bonded, may be aligned with one of the antinodes of standing wave. In order to position the sub-tank 14 so, the surface level of ink in the sub-tank 14, the oscillation frequency of the ultrasonic transducer 44, the sound velocity in the ink, and the material and wall-thickness of the sub-tank 14 are adjusted. Since the sub-tank 14 is so positioned, the first of the antinodes of the standing wave lies at the bottom of the sub-tank 14, which contacts the ultrasonic transducer 44.

Assume that the sound velocity in the ink is 1500 m/sec (or 1500000 mm/sec) and that the ultrasonic wave has frequency of 40 kHz (or 40000 Hz). Then, the wavelength=1500000÷40000=37.5 mm. As a result, the first antinode of sound pressure lies at distance of about 19 mm from the bottom of the sub-tank 14. Other antinodes are formed, following the first, at intervals of half the wavelength, toward the surface of ink.

The deeper each bubble 46 lies from the surface of ink, the faster it rises in the ink. It is therefore advisable to locate the ink outlet port 22*a* half the wavelength above the bottom of the sub-tank 14, namely about 19 mm above the bottom of the sub-tank 14. Thus, the bubbles 46 rise fast in that part 14*a* of the sub-tank 14, which lies near the ink outlet port 22*a*. Ink containing bubbles 46 would not flow into the ink outlet port 22*a*. The ink outlet port 22*a* may be located at distance of about 38 mm from the bottom of the sub-tank 14, not at distance of about 19 mm as specified above, if the following condition is satisfied:

V1>V2 where V1 is the speed of bubbles 46 rising in the part 14*a* of the sub-tank 14, and V2 is the speed of ink 26 flowing into the ink outlet port 22*a*.

Figure 5:
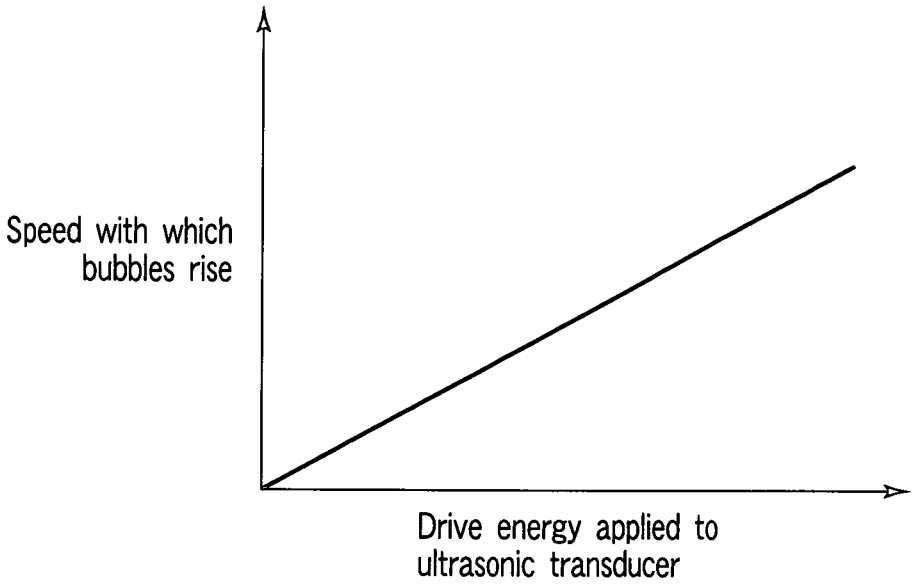
FIG. 5 is a graph representing a relation between the drive energy applied to the ultrasonic transducer and the rising speed of bubbles.

FIG. 5 is a graph representing a relation between the drive energy applied to the ultrasonic transducer and the rising speed of bubbles.

As seen from FIG. 5, the bubbles 46 will rise faster if the drive energy applied to the ultrasonic transducer 44 is increased. The speed with which the bubbles 46 rise can therefore be adjusted by changing the drive energy applied to the ultrasonic transducer 44. Nonetheless, this speed will increase with the temperature of the ink, as can be understood from FIG. 6. Hence, the speed with which the bubbles 46 rise may be increased by raising the temperature of ink, so far as the recording head 16 can operate well.

Thus, the drive energy for the ultrasonic transducer 44 and the temperature of the ink may be appropriately adjusted in accordance with the sound velocity in the ink 26 and the oscillation frequency of the transducer 44. Then, it suffices to arrange the ink outlet port 22*a* and the ultrasonic transducer 44 to achieve the following relation:

V1>V2 where V1 is the speed of bubbles 46 rising in the part 14*a* of the sub-tank 14, and V2 is the speed of ink 26 flowing into the ink outlet port 22*a*.

How ink is supplied through the ink passage during the ink-jet printing will be explained with reference to the flowchart of FIG. 7.

To start ink-jet printing in the ink-jet recording apparatus 10, the user first operates the operation panel (not sown) or the host apparatus (not shown) connected to the apparatus 10, inputting the number of prints to make (Step S1).

When the number of prints is set in Step S1, the ultrasonic transducer 44 starts operating (Step S2). If bubbles 46 exist in the sub-tank 14 when the ultrasonic transducer 44 starts operating in Step S2, they form an air layer near the ultrasonic transducer 44. The air layer moves upwards in Z-axis direction, and the bubbles 46 no longer exist in the part 14*a* of the sub-tank 14. Thus, the printing starts, with no bubbles 46 existing in the part 14*a* that lies near the ink outlet port 22*a*.

Next, the liquid-level sensor 42 determines whether the surface level of the ink 26 in the sub-tank 14 is equal to or higher than a threshold level (Step S3). If the liquid-level sensor 42 finds that the surface level of the ink 26 is equal to or higher than the threshold level (that is, the tank 14 is in ON state), the operation goes to Step S4. Then, the printing is performed on a recording medium 36 (Step 4).

While the printing is proceeding, the liquid-level sensor 42 keeps monitoring the surface level of ink in the sub-tank 14, determining whether the surface level is equal to or higher than the threshold level (Step S5). It is then determined whether prints have been made in the number set in Step S1 (Step S6). If YES in Step S6, the operation goes to Step S7, in which the ultrasonic transducer 44 is made to stop vibrating. Thus, the printing terminates.

In Step S6, it may be found that prints have not yet been made in the number set in Step S1. In this case, the operation returns to Step S4. Thus, Steps S4 to S6 are repeated until the number of prints reaches the preset value.

If the liquid-level sensor 42 detects in Step S3 or Step S5 that the surface level of ink in the sub-tank 14 is lower than the threshold level (that is, the tank 14 is in OFF state), the operation goes to Step S8, in which the sub-tank 14 is replenished with ink.

In the process of replenishing the sub-tank 14, the valve 18 is opened (Step S8). The ink 26 therefore flows from the ink tank 12 into the sub-tank 14 through the first ink passage 20. Then, the liquid-level sensor 42 provided in the sub-tank 14 determines whether the tank 14 is in ON state or not (Step S9). If YES in Step S9, the valve 18 is closed (Step S10). The operation then returns to Step S6.

If NO in Step S9 (that is, if tank 14 is in OFF state), the operation goes to Step S11. In Step S11, it is determined whether a predetermined time has elapsed after the valve 18 has been opened in Step S8. If NO in Step S11, the operation will return to Step S9. If YES in Step S11, this means that the ink tank 12 contains no ink. Therefore, the operation goes to Step S12, in which the valve 18 is closed. Thereafter, the ink tank 12 is replaced by a new one in Step S13. Then, the operation returns to Step S8.

As described above, the ink outlet port 22*a* of the second ink passage 22 is located near the ultrasonic transducer 44 in the first embodiment, in order to supply ink from the sub-tank 14 to the recording head 16. The bubbles existing near the ink outlet port 22*a* (i.e., bubbles staying in near the part 14*a* of the sub-tank 14) have risen before the ink is supplied to the recording head 16. Therefore, the printing can be started, with no bubbles moving into the ink outlet port 22*a*. That is, the bubbles in the ink 26 supplied anew from the ink tank 12 via the ink inlet port 20*a* of the first ink passage 20 are agitated by the ultrasonic transducer 44, rising before reaching the ink outlet port 22*a*. Hence, ink containing bubbles would not flow into the ink outlet port 22*a* even if the ink keeps flowing to the recording head 16, no matter whether the ink tank 12 is disconnected from or connected to the first ink passage 20 or whether the ink tank 12 is replenished with ink or not. This prevents faulty ink ejection due to bubbles, if any, and ensures stable printing all the time the ink-jet recording apparatus 10 operates.

A modification of the first embodiment will be described below.

Figure 8:
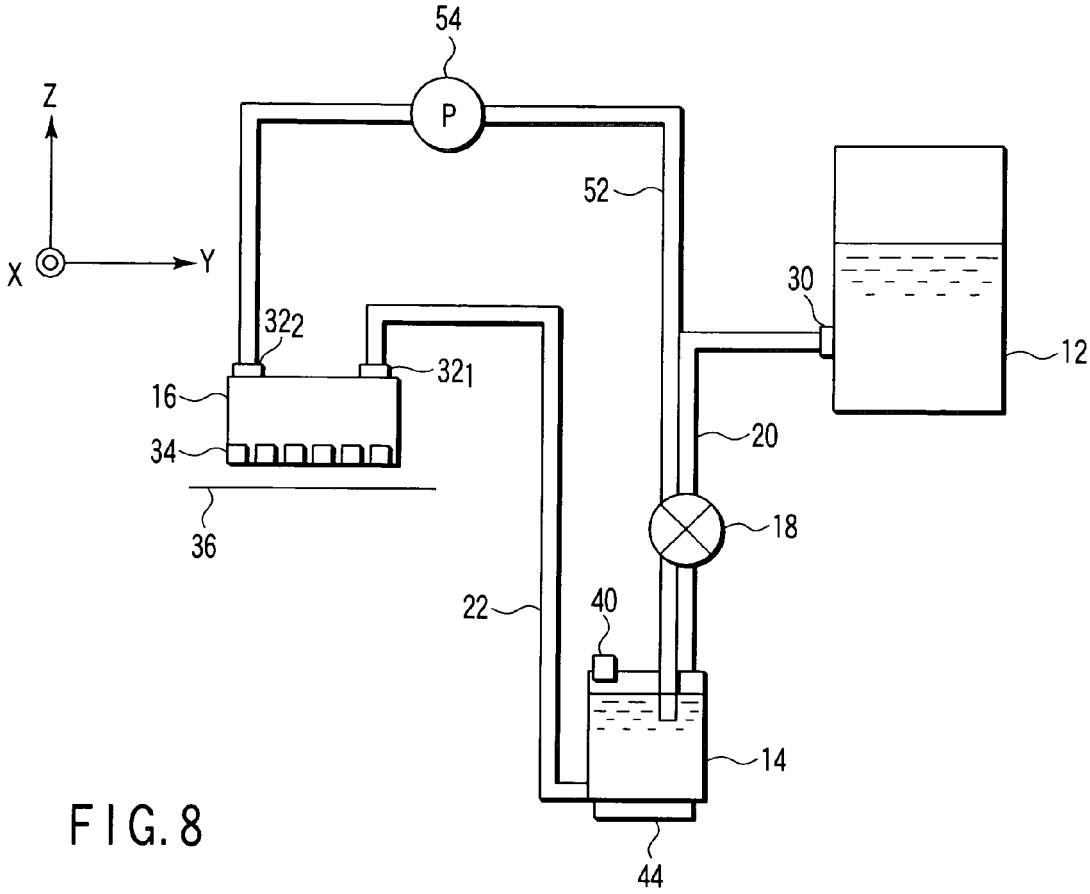
FIG. 8 is a diagram showing a modification of the first embodiment of the invention, schematically illustrating the ink passage in the ink-jet recording apparatus.

In the first embodiment described above, the ink 26 flows from the ink tank 14 to the recording head 16. Instead, the ink may be circulated through a third ink passage 52 as shown in FIG. 8. In this case, too, the advantages described above can be achieved.

FIG. 8 shows a modification of the first embodiment of the invention, illustrating the ink passage provided in a modified ink-jet recording apparatus.

As shown in FIG. 8, the third ink passage 52 is connected, at one end, by a joint 322 to the recording head 16; it can be disconnected from the recording head 16. The other end of the third ink passage 52 lies in the sub-tank 14, immersed in the ink contained in the sub-tank 14. A pump 54 is provided on the third ink passage 52. The pump 54 is driven, making the ink 26 flow through the second ink passage 22, recording head 16 and third ink passage 52. Thus, the second ink passage 22, recording head 16 and third ink passage 52 constitute an ink-flow circuit.

In any other respects, the modified ink-jet recording apparatus shown in FIG. 8 is identical to the apparatus 10 according to the first embodiment. Therefore, the components identical to those of the first embodiment are designated by the same reference numbers and will not be described.

Figure 7:
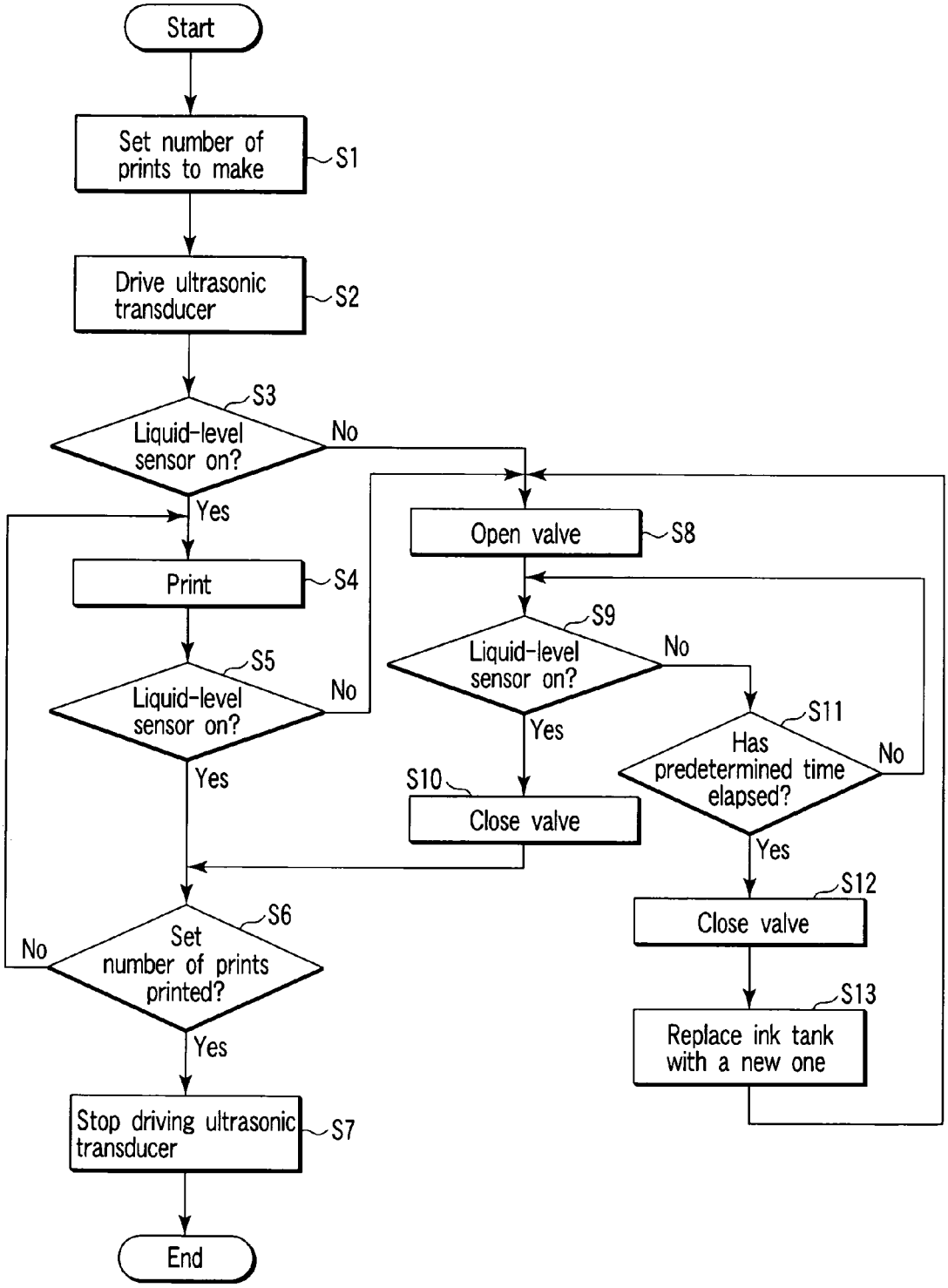
FIG. 7 is a flowchart explaining how ink is supplied while the ink-jet recording apparatus according to the first embodiment is printing data.

The ink is made to flow in the modified ink-jet recording apparatus in the same way as in the apparatus 10, except that the pump 54 is driven between Steps S1 and S2 (see the flowchart of FIG. 7). All other steps performed to supply the ink to the head 16 are identical to those shown in the flowchart of FIG. 7 and will not be explained here.

The modified ink-jet recording apparatus (FIG. 8) can achieve the same advantages as the first embodiment. In addition, the ink can be circulated through the recording head 16 all the time the modified ink-jet recording apparatus operates.

Second Embodiment

A second embodiment of the present invention will be described below.

Figure 9:
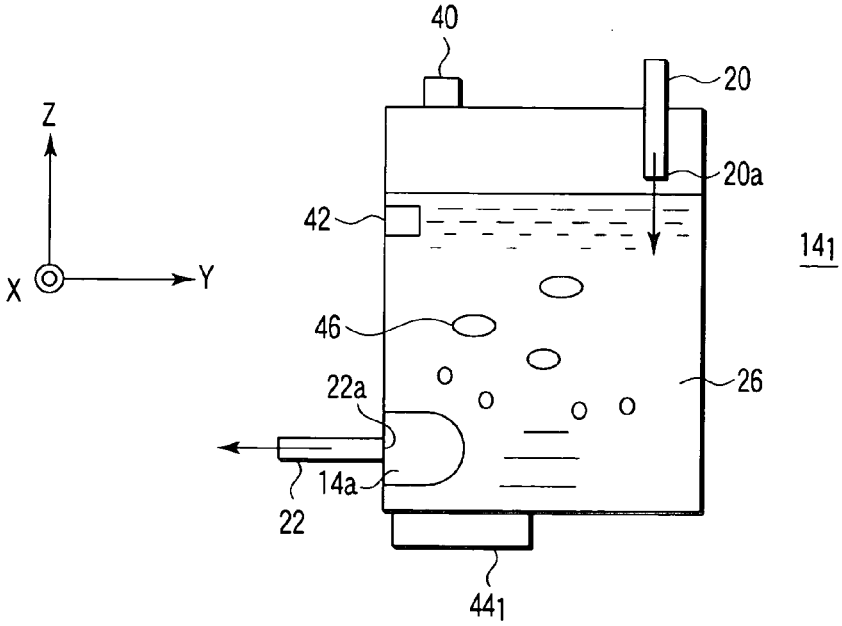
FIG. 9 is a magnified view of the sub-tank $\mathbf{14}_1$ provided in an ink-jet recording apparatus according to a second embodiment of the present invention.

FIG. 9 is a magnified view of the sub-tank $\mathbf{14}_1$ provided in an ink-jet recording apparatus according to the second embodiment.

The components of the second embodiment, which are identical to those of the first embodiment, are designated by the same reference numbers in FIG. 9. Further, the same functions or advantages the second embodiment achieves as the first embodiment will not be described.

The sound wave of an ultrasonic transducer is directive. Basically, it has a width equal to that of the transducer and propagates in the direction perpendicular to its surface on which the sub-tank is mounted. In the apparatus shown in FIG. 9, while the ink is flowing from the ink inlet port 20*a* of the first ink passage 20 to the ink outlet port 22*a* of the second ink passage 22, bubbles 46 must be removed from the ink, particularly at a position near the ink outlet port 22*a* of the second ink passage 22, which lies in the sub-tank $\mathbf{14}_1$. If the energy that drives the ultrasonic transducer $\mathbf{44}_1$ is increased, making the bubbles rise faster than the ink flowing in the second ink passage 22, it is not necessary to employ an ultrasonic transducer that is large enough to cover up the bottom of the sub-tank $14_1$. In other words, the same advantage as achieved in the first embodiment can be attained by providing a small ultrasonic transducer $44_1$ near the ink outlet port 22*a* of the second ink passage 22.

Figure 6:
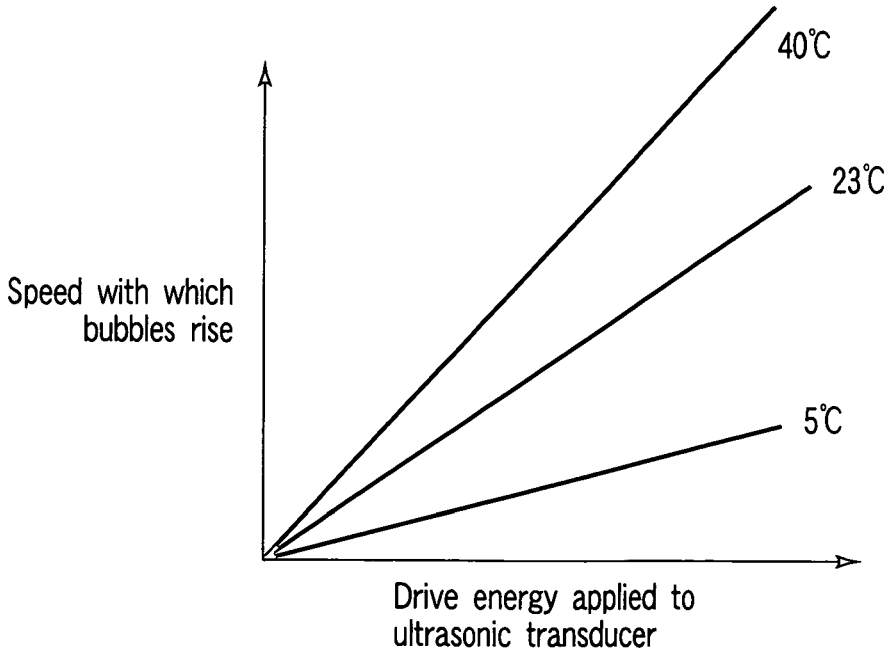
FIG. 6 is a graph representing a relation that the drive energy applied to the ultrasonic transducer and the rising speed of bubbles have with respect to the temperature used as parameter.

The speed with which the bubbles rise can be adjusted with the drive energy applied to the ultrasonic transducer $44_1$, or by adjusting the temperature of the ink as seen from in FIG. 6. Thus, the temperature of ink may be raised and the drive energy applied to the transducer $44_1$ may be increased. In other words, the drive energy and the ink temperature are appropriately controlled in accordance with the sound velocity in the ink 26 and the oscillation frequency of the ultrasonic transducer $44_1$. Then, the following relation can be satisfied:

$$V1>V2$$

where V1 is the speed of bubbles rising in the part 14*a*, and V2 is the speed of ink flowing into the ink outlet port 22*a*.

If this relation is satisfied, the ultrasonic transducer $44_1$ provided near the ink outlet port 22*a* can achieve advantages even if it is small. While the apparatus is performing printing, the ink flows through the same passage as in the first embodiment.

The small ultrasonic transducer $44_1$ provided near the ink outlet port 22*a* can achieve the same advantages as in the first embodiment, though not large enough to cover up the bottom of the sub-tank $14_1$, only if the drive energy and the ink temperature are appropriately controlled in accordance with the sound velocity in the ink and the oscillation frequency of the ultrasonic transducer $44_1$. Since the ultrasonic transducer $44_1$ is small, the modified apparatus can be manufactured at lower cost than the first embodiment.

Third Embodiment

A third embodiment of this invention will be described.

Figure 10:
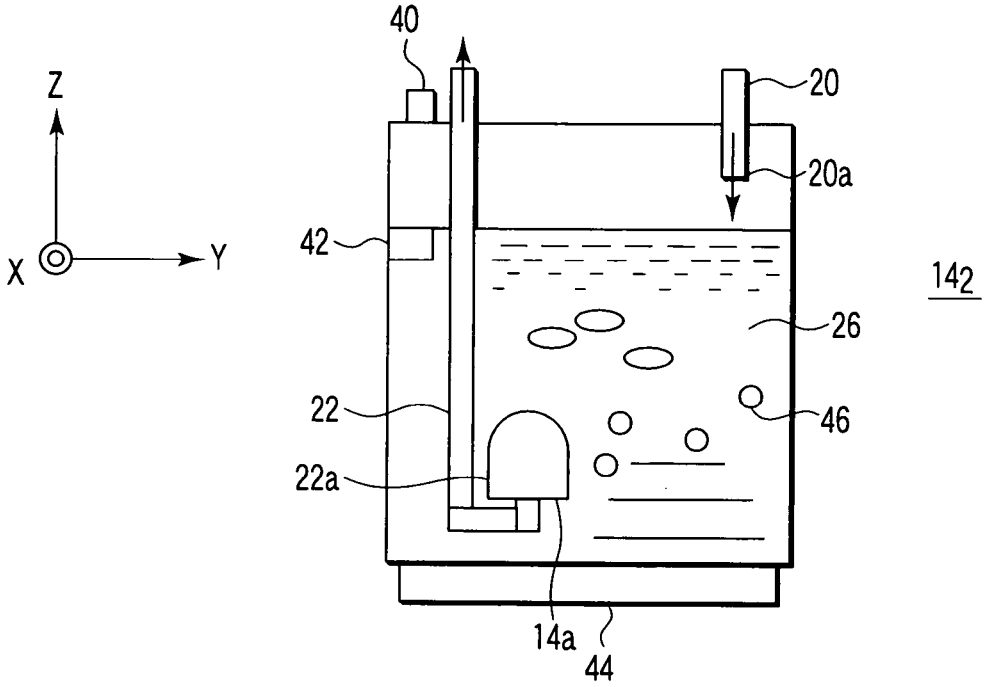
FIG. 10 is a magnified view of the sub-tank $\mathbf{14}_2$ provided in an ink-jet recording apparatus according to a third embodiment of the invention.

FIG. 10 is a magnified view of the sub-tank $14_2$ provided in an ink-jet recording apparatus according to the third embodiment of the present invention.

The components of the third embodiment, which are identical to those of the first embodiment, are designated by the same reference numbers in FIG. 9. Further, the same functions or advantages the third embodiment achieves as the first embodiment will not be described.

In the first and second embodiments, the second ink passage 22 is connected to one side of the sub-tank 14. In this embodiment, the second ink passage 22 is connected to the top wall of the sub-tank 14. Moreover, the ink outlet port 22*a* of the second ink passage 22 is turned upwards in Z-axis direction, because bubbles 46 tend to rise up in Z-axis direction. Since the ink outlet port 22*a* is turned upwards in Z-axis direction, the bubbles 46 that are rising from below the ink outlet port 22*a* can be prevented from moving into the ink outlet port 22*a*.

In the present embodiment, too, the ink outlet port 22*a* is located near the first of the antinodes of sound pressure that acts in the direction in which the sound wave emitted from the ultrasonic transducer 44 and having a width equal to that of the transducer 44.

The longer the distance the bubbles 46 travel from the ink inlet port 20*a* to the ink outlet port 22*a*, the longer the time they take to reach the ink outlet port 22*a*. It is therefore desirable to space the ink inlet port 20*a* and the ink outlet port 22*a* from each other by a long distance. The ink outlet port 22*a* can be located anywhere else, nevertheless, if the following relation is satisfied:

$$V1>V2$$

where V1 is the speed of bubbles rising in the part 14*a* near the ink outlet 22*a*, and V2 is the speed of ink flowing into the ink outlet port 22*a*.

As has been described, the third embodiment can achieve the same advantages as the first embodiment. Furthermore, the freedom of design increases, reducing the size of the apparatus and, thus, saving the installation space, because the second ink passage 22 is connected to the top wall of the sub-tank $14_2$. In addition, the bubbles in the ink are prevented from moving into the second ink passage 22, because the ink outlet port 22*a* of the second ink passage 22 is turned upwards in Z-axis direction.

Fourth Embodiment

A fourth embodiment of the present invention will be described, with reference to FIGS. 11 and 12.

Figure 11:
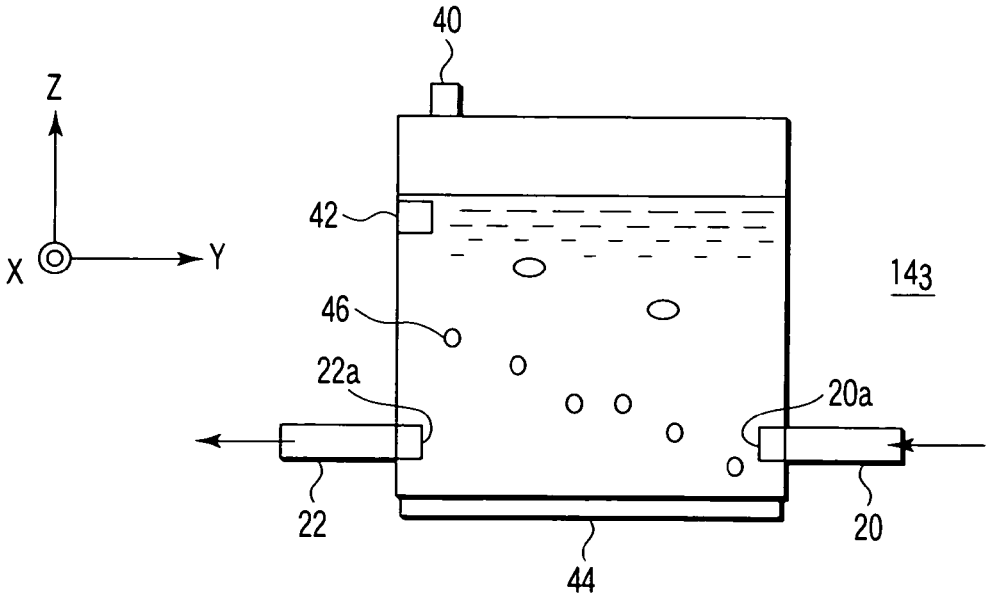
FIG. 11 is a diagram showing a fourth embodiment of the present invention, illustrating the ink inlet port 20*a* and the ink outlet port 22*a*, both provided in the bottom of the sub-tank $\mathbf{14}_3$.
Figure 12:
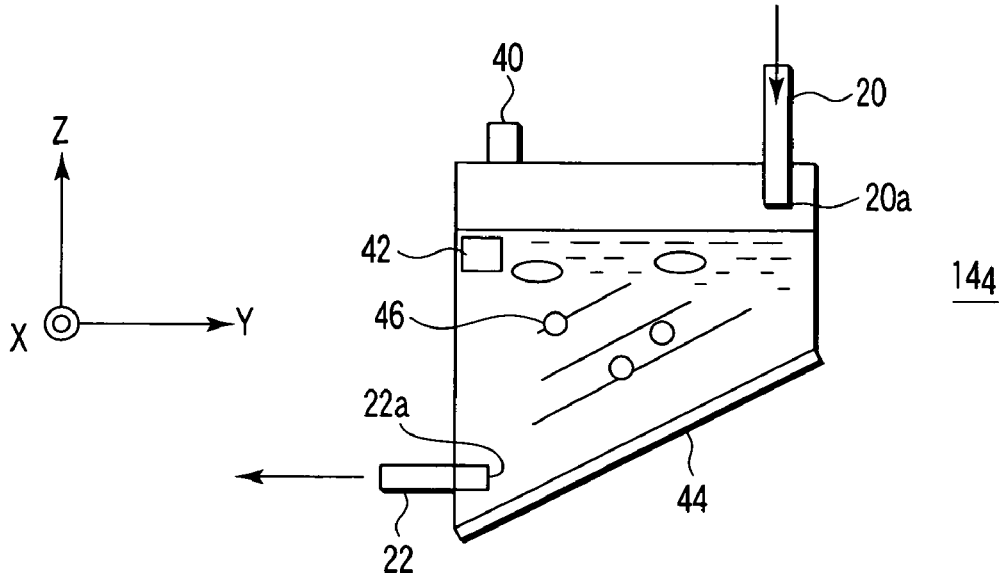
FIG. 12 is a diagram showing a fourth embodiment of the present invention, illustrating the sub-tank $\mathbf{14}_4$ having an inclined bottom.

The components of the fourth embodiment, which are identical to those of the first embodiment, are designated by the same reference numbers in FIGS. 11 and 12. Further, the same functions or advantages the fourth embodiment achieves as the first embodiment will not be described.

The bubbles 46 in the ink 26 supplied from through the ink inlet port 20*a* has the tendency of flowing in the shortest possible path, from the ink inlet port 20*a* to the ink outlet port 22*a*.

This is why the ultrasonic transducer 44 is arranged, extending along the shortest possible path that connects the ink inlet port 20*a* to the ink outlet port 22*a*, as is illustrated in FIGS. 11 and 12.

As shown in FIG. 11, the ink inlet port 20*a* is connected to one side of the sub-tank $14_3$ so that the shortest path that connects the port 20*a* to the ink outlet port 22*a* may extend substantially parallel to the bottom of the sub-tank $14_3$. On the bottom of the sub-tank $14_3$, the ultrasonic transducer 44 is provided. Thus, the ultrasonic transducer 44 is substantially parallel to the shortest path that connects the port 20*a* to the ink outlet port 22*a*. The ink inlet port 20*a* of the first ink passage 20, through which ink is supplied to the sub-tank $14_3$, is arranged near the ultrasonic transducer 44.

FIG. 12 shows a sub-tank $14_4$ into which the ink inlet port 20*a* of the first ink passage 20 extends from above.

As shown in FIG. 12, the bottom of the sub-tank $14_4$ is inclined from the ink inlet port 20*a* to the ink outlet port 22*a*, extending substantially parallel to the shortest possible path that connects the ink inlet port 20*a* to the ink outlet port 22*a*. On this inclined bottom, the ultrasonic transducer 44 is mounted.

Thus, the fourth embodiment can achieve the same advantages as the first embodiment. Further, the bubbles 46 can readily rise, never moving into the ink outlet port 22*a*, because the ultrasonic transducer 44 is arranged, extending along the shortest possible path that connects the ink inlet port 20*a* to the ink outlet port 22*a*.

Fifth Embodiment

A fifth embodiment of the present invention will be described, with reference to FIG. 13.

Figure 13:
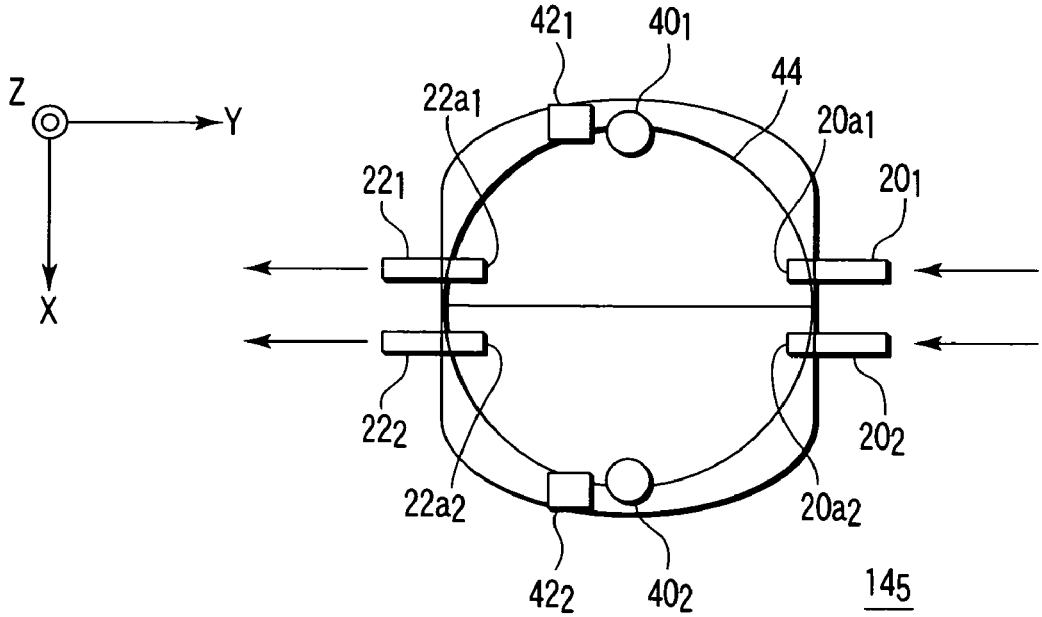
FIG. 13 is a magnified view of the sub-tank $\mathbf{14}_5$ provided in an ink-jet recording apparatus according to a fifth embodiment of the invention, as viewed from above in the direction of the Z axis shown in FIGS. 12, 13 and 14.

The components of the fifth embodiment, which are identical to those of the first embodiment, are designated by the same reference numbers in FIG. 13. Further, the same functions or advantages the fifth embodiment achieves as the first embodiment will not be described.

The present embodiment is an ink-jet recording apparatus that uses at least two kinds of ink, of different colors. In the ink-jet recording apparatus, one ultrasonic transducer removes bubbles from the two kinds of ink, which are contained in two sub-tanks.

FIG. 13 is a magnified view of the sub-tank $\mathbf{14}_5$ provided in an ink-jet recording apparatus according to the fifth embodiment, as viewed from above Z-axis direction.

As shown in FIG. 13, the sub-tank $\mathbf{14}_5$ is provided on a circular ultrasonic transducer 44 and partitioned into two chambers. The ink inlet ports $\mathbf{20}a_1$ and $\mathbf{20}a_2$ of two first ink passages $\mathbf{20}_1$ and $\mathbf{20}_2$, respectively, and the ink outlet ports $\mathbf{22}a_1$ and $\mathbf{22}a_2$ of two second ink passages $\mathbf{22}_1$ and $\mathbf{22}_2$, respectively, are located below the two tanks containing inks of different colors, respectively, and near the ultrasonic transducer 44, as in the case illustrated in FIG. 11. Further, an atmosphere port $\mathbf{40}_1$ and a liquid-level sensor $\mathbf{42}_1$ are provided for one ink tank, and an atmosphere port $\mathbf{40}_2$ and a liquid-level sensor $\mathbf{42}_2$ are provided for the other ink tank.

Thus, the fifth embodiment can achieve the same advantages as the first embodiment. In addition, since one ultrasonic transducer can serve to supply bubble-free inks to recording heads through the ink outlet ports $\mathbf{22}a_1$ and $\mathbf{22}a_2$, respectively, the apparatus according to the fifth embodiment can be manufactured at low cost.

Sixth Embodiment

A sixth embodiment of the present invention will be described, with reference to FIGS. 14 and 15.

Figure 14:
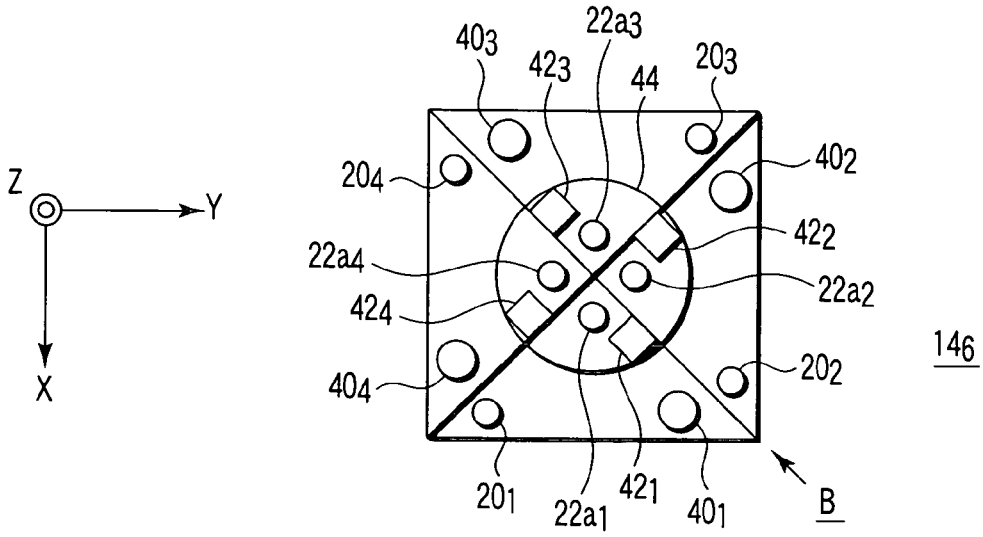
FIG. 14 is a magnified view of the sub-tank $\mathbf{14}_6$ provided in an ink-jet recording apparatus according to a sixth embodiment of the invention, as viewed from above in the direction A of the Z axis shown in FIG. 15.
Figure 15:
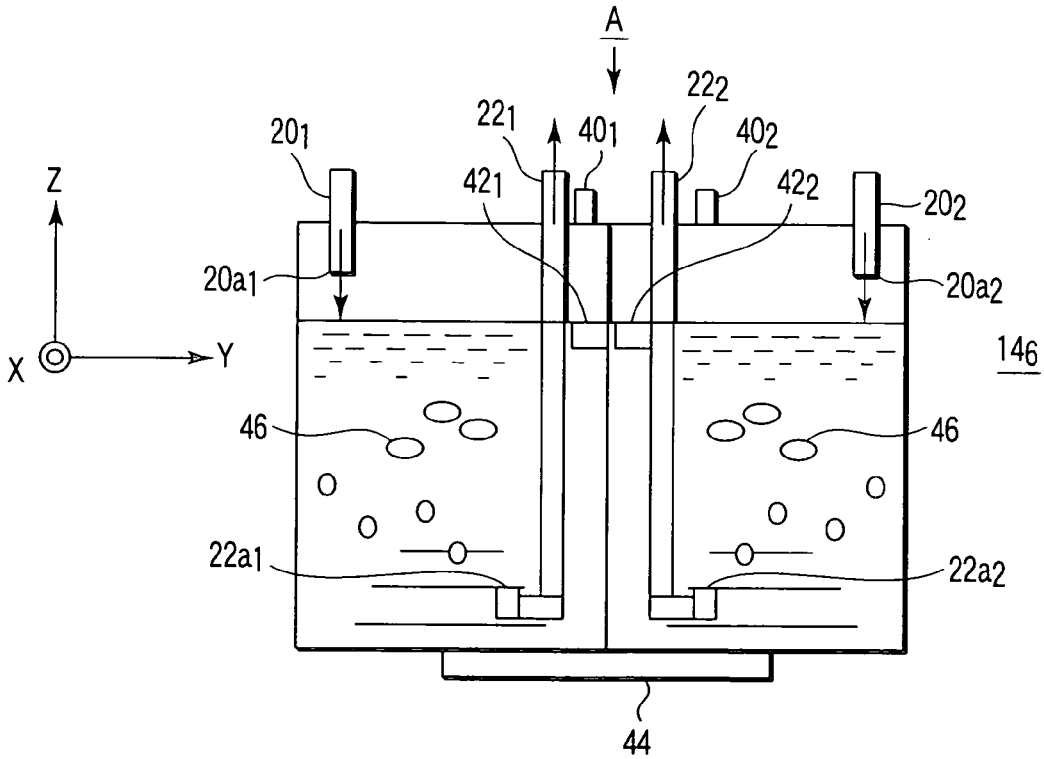
FIG. 15 is a magnified side view of the sub-tank $\mathbf{14}_6$ provided in an ink-jet recording apparatus according to the sixth embodiment of the invention, the side view being looked at in direction B shown in FIG. 14.

The components of the sixth embodiment, which are identical to those of the first embodiment, are designated by the same reference numbers in FIGS. 14 and 15. Further, the same functions or advantages the sixth embodiment achieves as the first embodiment will not be described.

FIGS. 14 and 15 are magnified views of the sub-tank $\mathbf{14}_6$ provided in an ink-jet recording apparatus according to the sixth embodiment. FIG. 14 shows the sub-tank $\mathbf{14}_6$, as viewed from above in the direction of arrow A shown in FIG. 15, or in Z-axis direction. FIG. 15 shows the sub-tank $\mathbf{14}_6$, as viewed in the direction of arrow B shown in FIG. 14.

The circular ultrasonic transducer 44 is provided at the center of a sub-tank $\mathbf{14}_6$. The sub-tank $\mathbf{14}_6$ is partitioned into four ink chambers, which contain four types of ink, of different colors, respectively. Four second ink passages $\mathbf{22}_1$ to $\mathbf{22}_4$ are inserted into the four chambers and have ink outlet ports $\mathbf{22}a_1$ to $\mathbf{22}a_4$, respectively. The ink outlet ports $\mathbf{22}a_1$ to $\mathbf{22}a_4$ are provided in the sub-tank, all turned upwards in Z-axis direction, and located near the ultrasonic transducer 44. Further, four atmosphere ports $\mathbf{25}_1$ to $\mathbf{25}_4$ are provided for the four ink chambers, respectively. Similarly, four liquid-level sensors $\mathbf{42}_1$ to $\mathbf{42}_4$ are provided for four ink chambers, respectively.

Thus, the sixth embodiment can achieve the same advantages as the first embodiment. Moreover, one ultrasonic transducer 44 can serve to supply four types of ink, of different colors, all free of bubbles 46, to recording heads 16 through the ink outlet ports $\mathbf{22}a_1$ to $\mathbf{22}a_4$. The apparatus according to the sixth embodiment can be manufactured at low cost.

Seventh Embodiment

A seventh embodiment of this invention will be described, with reference to FIGS. 16 to 18.

Figure 16:
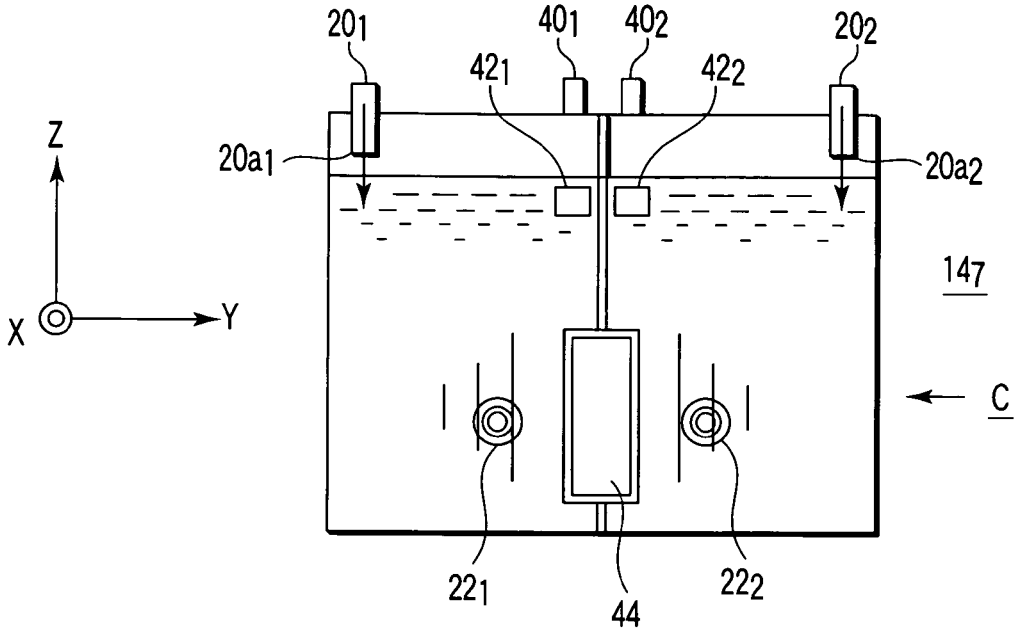
FIG. 16 is a magnified side view of the sub-tank $\mathbf{14}_7$ provided in an ink-jet recording apparatus according to a seventh embodiment of the invention.
Figure 18:
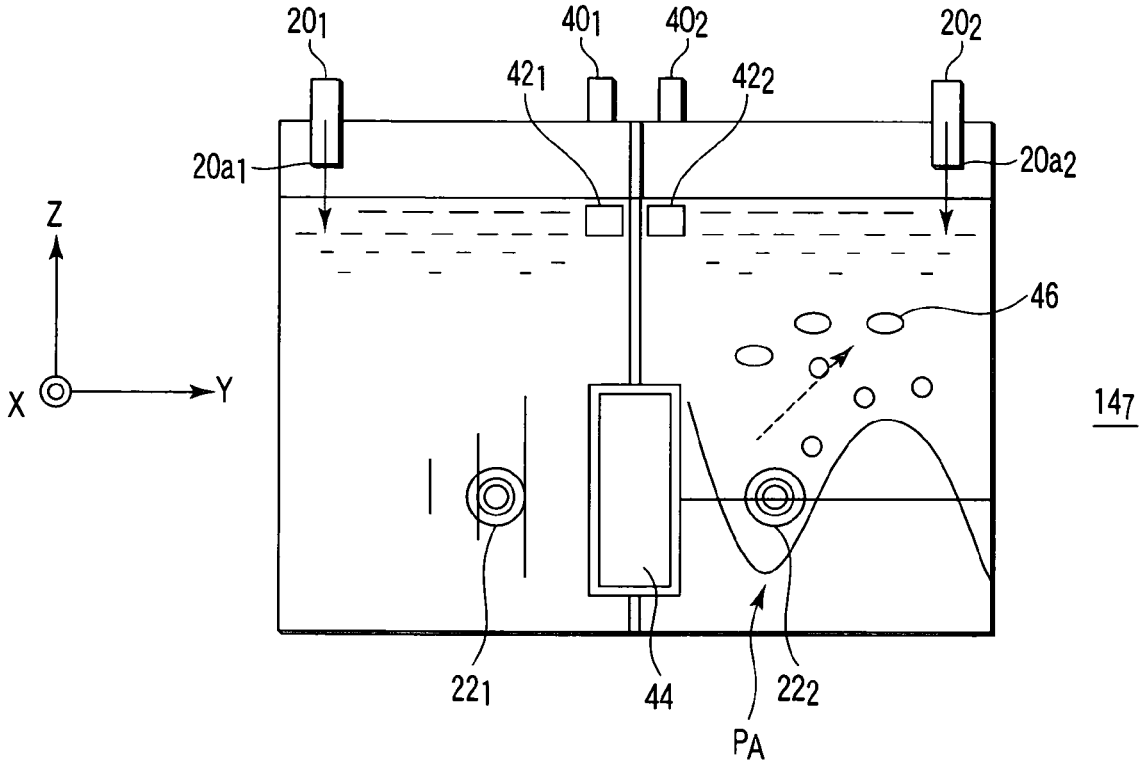
FIG. 18 is a magnified view of the sub-tank $\mathbf{14}_7$ provided in an ink-jet recording apparatus according to the seventh embodiment, explaining how a sound wave propagates from the ultrasonic transducer provided in the apparatus.

The components of the seventh embodiment, which are identical to those of the first embodiment, are designated by the same reference numbers in FIGS. 16 and 18. Further, the same functions or advantages the seventh embodiment achieves as the first embodiment will not be described.

Figure 17:
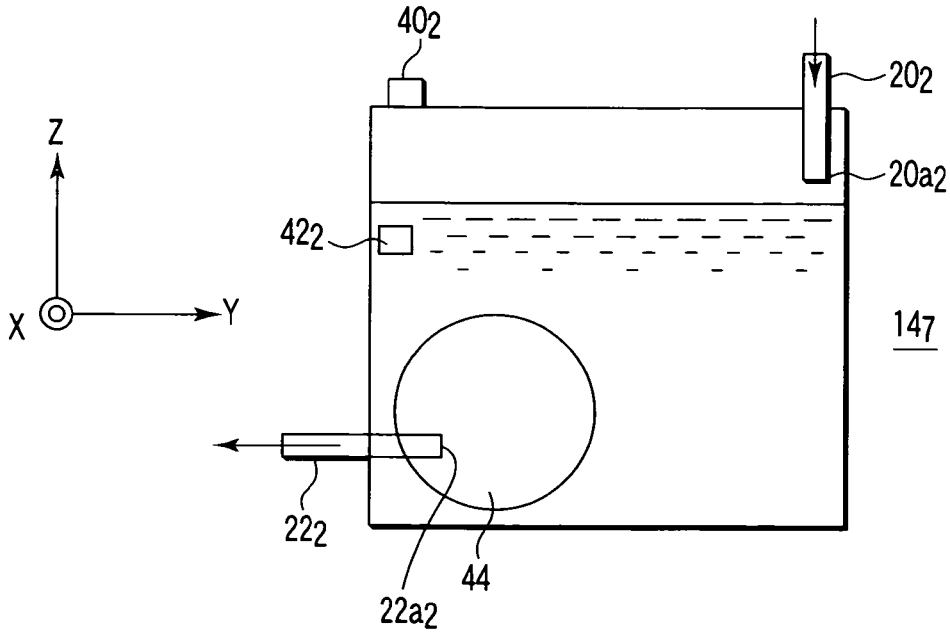
FIG. 17 is a magnified view of the sub-tank $\mathbf{14}_7$ provided in an ink-jet recording apparatus according to the seventh embodiment, as viewed in the direction of arrow C shown in FIG. 16.

FIGS. 16 to 18 are magnified views of the sub-tank $\mathbf{14}_7$ provided in an ink-jet recording apparatus according to the seventh embodiment. FIG. 16 is a side view of the apparatus. FIG. 17 shows the apparatus as viewed in the direction of arrow C shown in FIG. 16. FIG. 18 is a diagram explaining how a sound wave propagates from the ultrasonic transducer provided in the apparatus.

The seventh embodiment is a modification of the fifth embodiment. It is characterized in that a circular ultrasonic transducer 44 is interposed between two tanks as shown in FIG. 16, not below the sub-tank as in the fifth embodiment.

As seen from FIG. 16, the ultrasonic transducer 44 extends parallel to Z axis. Hence, as shown in FIG. 18, a sound wave having the same width as the ultrasonic transducer 44 propagates in the XY plane. At this point, bubbles 46 move up in Z-axis direction, away from the ultrasonic transducer 44.

As FIG. 17 shows, the ink outlet ports $\mathbf{22}a_1$ and $\mathbf{22}a_2$ of two second ink passages $\mathbf{22}_1$ and $\mathbf{22}_2$ are provided, overlapping the circular ultrasonic transducer 44. The ink outlet ports $\mathbf{22}a_1$ and $\mathbf{22}a_2$ are located near one of the antinodes PA of a sound pressure. Further, they are positioned as close as possible to the bottom of the sub-tank $\mathbf{14}_7$, with respect to Z-axis direction.

Thus, the seventh embodiment can achieve the same advantages as the first embodiment. In addition, since the ultrasonic transducer is between two tanks, the apparatus according to the seventh embodiment can save the installation space.

Several embodiments of this invention have been described. The present invention is not limited to them, nonetheless. Needless to say, various changes and modifications can be made, without departing from the scope and sprint of the invention.

Further, the embodiments described above include various phases of the invention. The components disclosed herein may be combined in various ways to make various inventions. Even if some components of any embodiment described above are not used, it is possible to achieve the object specified above. Any configuration not using some components can be considered as the invention so long as it achieves at least one of the advantages that will be stated in the "Advantages of the Invention."

According to the present invention, the ultrasonic transducer secured to the tank has a specific positional relation with the ink outlet port of the tank and bubble-free ink is therefore continuously supplied to the recording head at high efficiency.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An ink-jet recording apparatus comprising an ink tank containing ink, a recording head, an ink passage extending from the ink tank to the recording head, and a sub-tank provided on the ink passage, wherein the ink-jet recording apparatus is configured to record images on a recording medium, and the apparatus further comprises:

a first ink passage having an ink inlet port through which the ink is supplied from the ink tank to the sub-tank;

a second ink passage having an ink outlet port through which the ink is drawn from the sub-tank and supplied to the recording head; and an ultrasonic transducer configured to generate an ultrasonic wave, thereby forming a standing-wave field in the ink contained in the sub-tank, wherein the standing-wave field has a sound-pressure antinode, and wherein the ink outlet port of the second ink passage is arranged: (i) near the ultrasonic transducer, and (ii) at a position corresponding to the sound-pressure antinode of the standing-wave field.

2. The ink-jet recording apparatus according to claim 1, wherein the ultrasonic transducer is arranged on a bottom of the sub-tank, and the ink outlet port is arranged near said sound-pressure antinode that is formed before other sound-pressure antinodes, with respect to a direction in which the ultrasonic wave generated by the ultrasonic transducer propagates from the bottom of the sub-tank.

3. The ink-jet recording apparatus according to claim 1, wherein the ultrasonic transducer is arranged on a bottom of the sub-tank.

4. The ink-jet recording apparatus according to claim 3, wherein the ink outlet port of the second ink passage is provided near the bottom of the sub-tank.

5. The ink-jet recording apparatus according to claim 2, wherein the ink outlet port of the second ink passage opens upwards with respect to a direction of gravity.

6. The ink-jet recording apparatus according to claim 4, wherein the ink outlet port of the second ink passage opens upward with respect to a direction of gravity.

7. The ink-jet recording apparatus according to claim 2, wherein the ink outlet port of the second ink passage opens to a direction that is substantially at right angles to a direction of gravity.

8. The ink-jet recording apparatus according to claim 4, wherein the ink outlet port of the second ink passage opens to a direction that is a substantially at right angles to a direction of gravity.

9. The ink-jet recording apparatus according to claim 1, wherein the ultrasonic transducer is arranged substantially parallel to a shortest possible path along which the ink flows from the ink inlet port of the first ink passage to the ink outlet port of the second ink passage.

10. The ink-jet recording apparatus according to claim 1, further comprising at least one additional sub-tank, wherein the ultrasonic transducer is provided in common for said sub-tank and said at least one additional sub-tank.

11. The ink-jet recording apparatus according to claim 10, wherein the ultrasonic transducer is arranged on bottoms of said sub-tank and said at least one additional sub-tank.

12. The ink-jet recording apparatus according to claim 11, wherein the second ink passage includes a plurality of ink outlet ports that are provided near the bottoms of said sub-tank and said at least one additional sub-tank, respectively.

13. The ink-jet recording apparatus according to claim 12, wherein each of the plurality of the ink outlet ports of the second ink passage is arranged near a sound-pressure antinode of the standing-wave field.

14. The ink-jet recording apparatus according to claim 13, wherein each of the plurality of the ink outlet ports is arranged near a sound-pressure antinode which is formed first in a propagation direction of the ultrasonic wave emitted by the ultrasonic transducer and output from the respective bottoms of the sub-tanks.

15. The ink-jet recording apparatus according to claim 10, wherein the ultrasonic transducer is arranged between said sub-tank and said at least one additional sub-tank.

16. The ink-jet recording apparatus according to claim 15, wherein a plurality of ink outlet ports respectively corresponding to said sub-tank and said at least one additional sub-tank are arranged near the ultrasonic transducer.

17. The ink-jet recording apparatus according to claim 16, wherein each of the plurality of the ink outlet ports is arranged near a sound-pressure antinode which is formed first in a propagation direction of the ultrasonic wave emitted by the ultrasonic transducer.

18. The ink-jet recording apparatus according to claim 1, wherein the ultrasonic transducer is configured to be driven only when the apparatus prints data.

19. An ink-jet recording apparatus comprising an ink tank containing ink, a recording head, an ink passage extending from the ink tank to the recording head, and a sub-tank provided on the ink passage, wherein the ink-jet recording apparatus is configured to record images on a recording medium, and the apparatus further comprises:

a first ink passage configured to supply the ink in the ink tank to the sub-tank;

a second ink passage configured to draw the ink in the sub-tank and supply the ink to the recording head; and an ultrasonic transducer arranged on a bottom of the sub-tank and configured to generate an ultrasonic wave, thereby forming a standing-wave field in the ink contained in the sub-tank, wherein an end portion of the second ink passage connected to the sub-tank is arranged at a position corresponding to an antinode of sound pressure of the standing-wave field.

20. The ink-jet recording apparatus according to claim 19, wherein the end portion of the second ink passage is arranged at the position corresponding to the antinode of sound pressure, which has been formed first in a propagation direction of the ultrasonic wave.

* * * * *